US006089401A

United States Patent [19]

Salåker

[11] Patent Number: 6,089,401

[45] Date of Patent: Jul. 18, 2000

[54] BRAKING ARRANGEMENT FOR DISPENSERS OF CONTINUOUS MATERIAL

[75] Inventor: Allan Salåker, Vikmanshyttan, Sweden

[73] Assignee: SCA Hygiene Paper AB, Goteborg, Sweden

[21] Appl. No.: 09/101,852

[22] PCT Filed: Jan. 16, 1997

[86] PCT No.: PCT/SE97/00055

§ 371 Date: Sep. 25, 1998

§ 102(e) Date: Sep. 25, 1998

[87] PCT Pub. No.: WO97/26818

PCT Pub. Date: Jul. 31, 1997

[30] Foreign Application Priority Data

Jan. 23, 1996 [SE] Sweden ..... 9600235-7

[51] Int. Cl.[7] ..... B65H 1/00

[52] U.S. Cl. ..... 221/33; 221/33; 221/43; 225/11; 225/15; 225/17; 242/419.6; 242/564.1; 242/565

[58] Field of Search ..... 221/33, 43; 242/419.6, 242/419.7, 564.1, 564.2, 565; 225/11, 15, 19, 79, 106, 52

[56] References Cited

U.S. PATENT DOCUMENTS

| | | | |
|---|---|---|---|
| 1,224,224 | 5/1917 | Shelley | 242/565 X |
| 1,746,582 | 2/1930 | Elder | 225/106 |
| 4,818,042 | 4/1989 | Arabia et al. | 312/38 |
| 4,826,062 | 5/1989 | Buob et al. | 225/2 |
| 5,118,011 | 6/1992 | Kopp | 222/98 |
| 5,310,083 | 5/1994 | Rizzuto | 221/63 |
| 5,452,832 | 9/1995 | Niada | 225/11 |
| 5,577,634 | 11/1996 | Morand | 221/43 |

FOREIGN PATENT DOCUMENTS

| | | |
|---|---|---|
| 0 287 545 A1 | 10/1988 | European Pat. Off. . |
| 1 227 074 | 12/1965 | Germany . |
| 458 902 | 5/1989 | Sweden . |

*Primary Examiner*—Christopher P. Ellis
*Assistant Examiner*—Richard Ridley
*Attorney, Agent, or Firm*—Burns, Doane, Swecker & Mathis, L.L.P.

[57] ABSTRACT

A braking arrangement for dispensers of continuous material particulary paper dispensers includes a first gearwheel arranged for rotation about a first axis, and second gearwheel arranged for rotation about a second axis. The second gearwheel is arranged for displacement relative to the first gearwheel such that the second axis remains parallel to the first axis. In addition, the second gearwheel is biased towards the first gearwheel to partially intermesh therewith such that a variable gap is defined between the first and second gearwheel for passage of a continuous material.

10 Claims, 4 Drawing Sheets

BRAKING ARRANGEMENT FOR DISPENSERS OF CONTINUOUS MATERIAL

TECHNICAL FIELD

The present invention relates to a braking arrangement for use in connection with dispensers of continuous material such as paper. The invention further relates to a dispenser equipped with such a braking arrangement.

BACKGROUND OF THE INVENTION

Paper may be dispensed from dispensers predominantly in three main ways. Firstly, the paper may be in the form of individual sheets of predetermined size which are arranged within the dispenser such that the removal of one sheet causes a portion of a subsequent sheet to be exposed ready for removal. Secondly, the paper may be in the form of a continuous sheet and the dispenser is provided with a serrated or sharpened edge against which the sheet is brought to sever a certain length from the sheet. Thirdly, the paper may be in the form of a continuous sheet with perforations to allow a predetermined length of the sheet to be torn from the remainder of the sheet along the perforations. The feeding of the paper from these three types of paper may be manually or automatically achieved.

The present invention is primarily concerned with the manual dispensing of perforated paper from a dispenser, though it is to be understood that the invention may also be applied to dispensers of the second type described above.

In a known dispenser of perforated paper, the paper is in the form of a roll having a longitudinal axis. The paper is arranged in the dispenser such that the paper is unwound from the centre of the roll in a vertically downward direction through a dispensing nozzle. The dispensing nozzle is in the form of a truncated cone. As the paper passes through the nozzle, a braking force on the paper builds up due to friction between the sheet of paper and the inner surface of the nozzle. Provided that this braking force is sufficiently high, once a perforated length of the sheet of paper has passed through the nozzle, the weakening in the continuous sheet along the perforations will result in a length of the continuous sheet being torn from the remainder of the sheet.

Although the above-described dispenser has enjoyed commercial success, it does suffer from several disadvantages. Firstly, the braking force which is generated by the passage of the paper through the dispensing nozzle is very much dependent on the grade of paper being dispensed. Accordingly, the dispensing nozzle must be provided with an opening of variable size to thereby vary the braking force in order for the dispenser to be able to function with paper of different grade. Secondly, when the dispenser is charged with a new roll, the free end of the roll must be pushed through the nozzle to expose a length of sheet sufficiently long to allow it to be gripped. Since, in order to generate the requisite braking force, the nozzle is relatively long and narrow, difficulties arise in passing the free end of the roll through the nozzle.

SUMMARY OF THE INVENTION

It is therefore an object of the present invention to provide a braking arrangement for use in dispensers of continuous material which overcomes the disadvantages identified above.

This object is achieved by a braking arrangement according to one aspect of the invention.

Since in accordance with the present invention, the sheet of material is passed between a pair of parallel, partially intermeshing gearwheels, the level of the braking force which is generated is much less dependent on the grade of material of the sheet.

It is a further object of the present invention to provide a dispenser for dispensing a continuous paper sheet, which dispenser overcomes the disadvantages associated with previous continuous paper sheet dispensers.

This object is achieved by a dispenser according to another aspect of the invention.

Advantageous embodiments of the braking arrangement and dispenser according to the present invention are detailed in the respective dependent claims.

BRIEF DESCRIPTION OF THE DRAWINGS

The invention will be described in the following in greater detail by way of example only and with reference to the attached drawings, in which.

Figure 1:
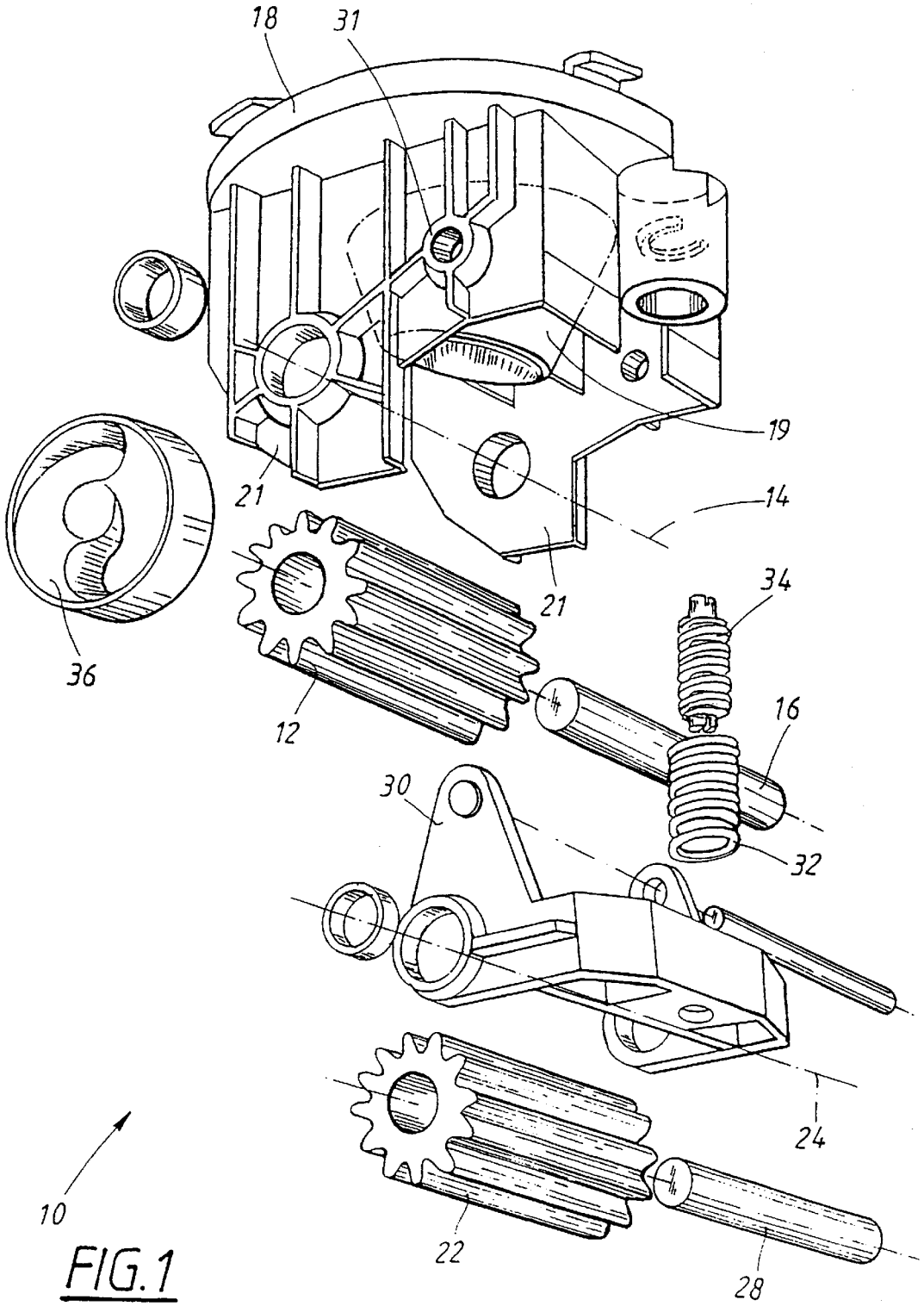
FIG. 1 is a schematic exploded perspective view of components of one embodiment of the braking arrangement according to the invention.

DETAILED DESCRIPTION OF PREFERRED EMBODIMENTS:

In the drawings, reference numeral 10 generally denotes a braking arrangement according to the present invention. The braking arrangement 10 is intended primarily for use with dispensers of continuous material, particularly paper dispensers. In accordance with the present invention, the braking arrangement 10 comprises a first gearwheel 12 which is arranged for rotation about a first axis 14. Advantageously, the first gearwheel 12 is keyed to a spindle 16 which in turn is journalled for rotation in a chassis 18. The chassis 18 is intended to be mounted to a dispenser, e.g. a paper dispenser, and is provided with a generally conical shaped dispensing nozzle 19 through which the contents of the dispenser 20 (FIG. 2) can be dispensed. As is most clearly apparent from FIG. 1, the chassis 18 comprises a pair of spaced flanges 21 which support the spindle 16 to thereby allow the first gearwheel 12 to rotate between the spaced flanges 21 at a fixed position beneath the dispensing nozzle 19.

Figure 3:
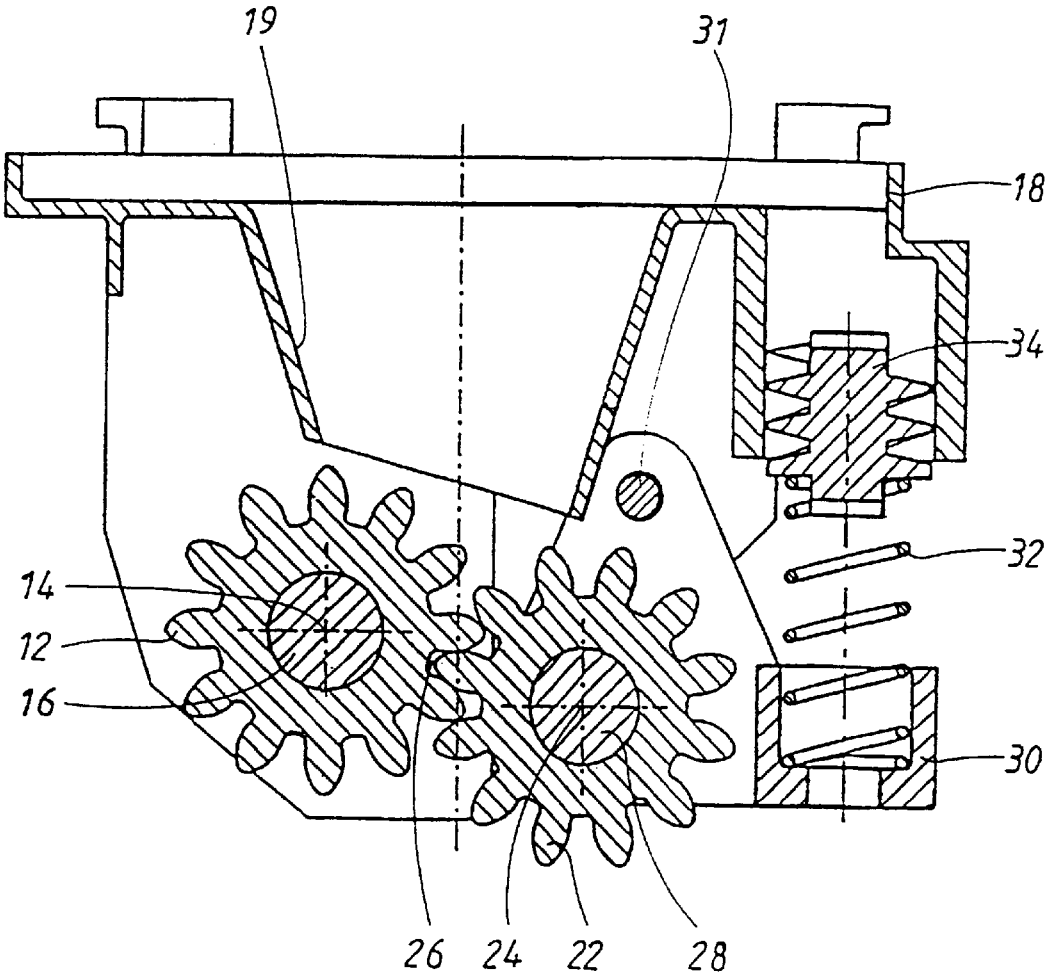
FIG. 3 is a sectional view along a centreline of the arrangement shown in FIG. 2.

In accordance with the present invention, the braking arrangement 10 further comprises a second gearwheel 22 which is arranged for rotation about a second axis 24. The second gearwheel 22 is arranged for displacement relative to the first gearwheel 12 such that the second axis 24 always remains parallel to the first axis 14. Irrespective of the position of the second gearwheel relative the first gearwheel, the first axis 14 is always above the second axis 24, i.e. closer to the top of the chassis as shown in the drawings. Furthermore, and as is most clearly apparent from FIG. 3, the second gearwheel 22 is biased towards the first gearwheel 12 to partially intermesh therewith such that a variable gap 26 is defined between the first and second gearwheel for passage of the continuous material.

Advantageously, and as shown in the drawings, in order to permit the second gearwheel 22 to be displaceable relative the first gearwheel 12, the second gearwheel is keyed to a spindle 28 which in turn is carried by a generally U-shaped cradle 30 in such a manner that the second gearwheel may rotate between the arms of the U-shaped cradle. As is clearly shown in FIG. 3, the cradle 30 is journalled to the chassis 18 at support locations 31 such that the first and second gearwheels 12, 22 may partially intermesh. It is further apparent from FIG. 3 that the cradle 30 is acted upon by a spring force generated by a spring 32 mounted on the chassis 18 to thereby bias the cradle, and thus also the second gearwheel, towards said first gearwheel 12. In order to ensure that the first and second axes 14, 24 remain parallel, the spring 32 is advantageously arranged to act on a region of the cradle 30 which is substantially equidistant from the support locations 31 when the cradle is journalled to the cradle on the chassis.

To prevent the spring from completely closing the variable gap 26 between the gearwheels, thereby hindering the passage of continuous material 20, the braking arrangement is suitably provided with (not shown) stop means, such as interacting surfaces on the cradle 30 and the chassis 18 or spacer discs carried on the spindles 16 and 28, which contact each other when a predetermined minimum gap is reached. Naturally, this predetermined minimum gap may be made adjustable by suitable means, such as interchangeable spacer discs.

To enable the braking arrangement to be used with different types of dispenser containing different materials, the force generated by the spring 32 is preferably adjustable. Adjustment may be achieved in any conventional manner, for example by the provision of an adjustment screw 34 carried by the chassis 18, which screw can be rotated to compress or expand the spring.

Figure 2:
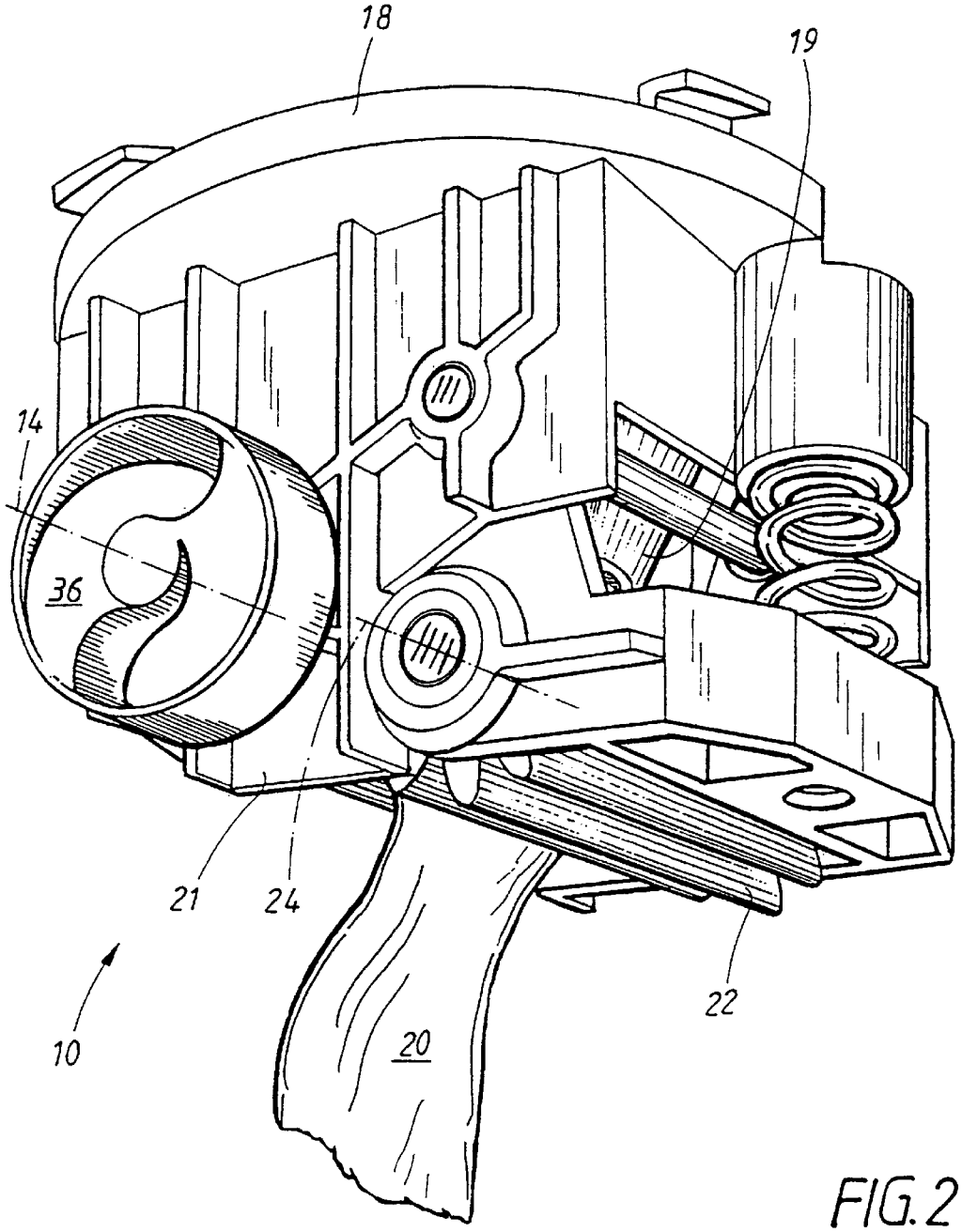
FIG. 2 is a schematic perspective view of the braking arrangement of FIG. 1 in an assembled state.

As will be apparent from FIG. 1, the first gearwheel 12 may be arranged to cooperate with a manually actuable feed wheel 36 which may be used to rotate the first gearwheel to aid in the initial through feed of material when e.g. the dispenser is provided with a new roll of paper. Naturally, the braking arrangement 10 may, if desired, be provided with an automatic feeding means, for example an electric motor, to rotate the gearwheels.

Figure 4B:
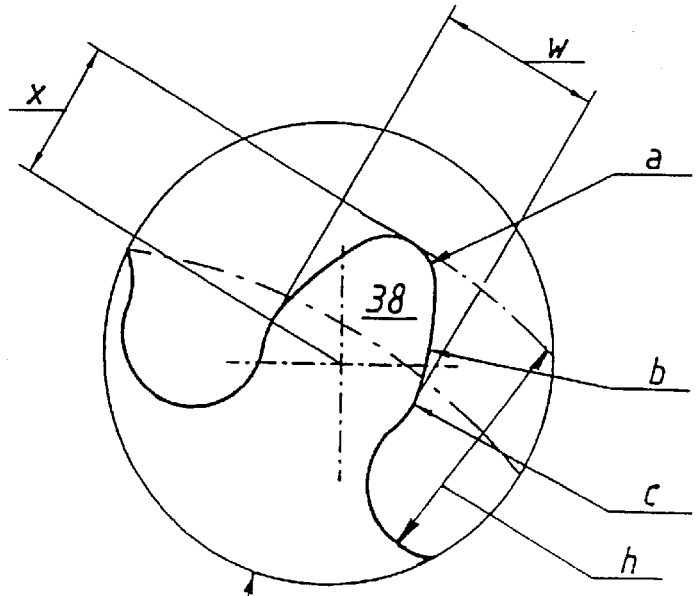
FIG. 4*b* is a view of a tooth on the gearwheel of FIG. 4*a* shown on a larger scale.
Figure 4A:
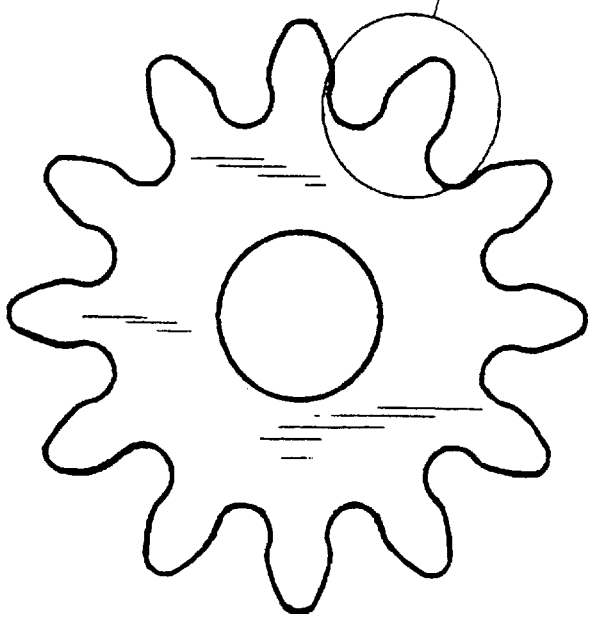
FIG. 4*a* is an end view on a larger scale of a gearwheel incorporated in the braking arrangement according to the present invention.

Tests have shown that, when operated in conjunction with perforated paper, the braking arrangement according to the present invention functions best when the first and second gearwheels 12, 22 are substantially identical. Suitably, each gearwheel should be provided with nine to fifteen substantially identical teeth, preferably twelve teeth. As shown in FIGS. 4*a* and 4*b*, each tooth 38 should have only rounded edges, i.e. no sharp edges, to thereby prevent the continuous material from being ripped. In a preferred embodiment of the invention in which the braking arrangement 10 is utilized with a dispenser for perforated paper, each gearwheel has an external diameter d of 42 mm and is provided with 12 teeth. The height h of each tooth is 7 mm, the maximum distance between opposed faces of the tooth w is 4.7 mm, with the various radii of curvature of the tooth a, b, c, as shown in FIG. 4*b* being 1.4, 10 and 2.35 mm respectively. Finally, the distance x from the tip of each tooth to the region of maximum width is 4 mm. The gearwheels 12, 22 may be made from extruded aluminium and the spindles 16, 28 from a suitable steel. The chassis 18 may be made from aluminium or a glassfibre-reinforced polymer.

As mentioned earlier, the braking arrangement 10 according to the present invention may suitably be utilized in a dispenser for dispensing a continuous paper sheet. The paper sheet may be in the form of a roll of paper having a longitudinal axis. Depending on the type of dispenser, the roll of paper may be arranged in the dispenser such that the longitudinal axis of the roll of paper is aligned with the nozzle 19 on the chassis 18. In such a case, it is advantageous if the roll is such that paper can be drawn from the centre of the roll rather than the periphery. Alternatively, the roll of paper may be arranged in the dispenser such that the longitudinal axis of the roll of paper is substantially parallel to the first and second axes 14, 24 of the braking arrangement 10.

Naturally, the invention is not to be restricted to the embodiments described above and shown in the drawings, but may be varied within the scope of the appended claims. For example, the braking arrangement may be used in dispensers of material other than paper.

What is claimed is:

1. A braking arrangement for dispensers of continuous material, particulary paper dispensers, said arrangement comprising:

a first gearwheel being arranged for rotation about a first axis carried by a chassis;

a second gearwheel being arranged for rotation about a second axis, said second axis being carried by a cradle, said cradle being journalled to said chassis; said second gearwheel being arranged for displacement relative to said first gearwheel such that said second axis remains parallel to said first axis;

a dispensing nozzle for dispensing said continuous material in a downstream direction towards said first and second gearwheels; and wherein said second gearwheel is biased towards said first gearwheel to partially intermesh therewith such that a variable gap is defined between said first and second gearwheel for passage of said continuous material, and wherein said first axis is located closer to said nozzle than said second axis.

2. The braking arrangement as claimed in claim 1, wherein said cradle is acted upon by a spring force generated by a spring mounted on said chassis to thereby bias said second gearwheel towards said first gearwheel.

3. The braking arrangement as claimed in claim 2, wherein said spring force is adjustable.

4. The braking arrangement as claimed in claim 1, wherein said first gearwheel cooperates with a manually actuable feed wheel for rotation of said first gearwheel.

5. The braking arrangement as claimed in claim 1, wherein said first and second gearwheels are substantially identical, each gearwheel being provided with 9 to 15 substantially identical teeth, each tooth having only rounded edges to thereby prevent said continuous material from being ripped.

6. A dispenser for dispensing a continuous paper sheet, said paper sheet being in the form of a roll of paper having a longitudinal axis, wherein said dispenser is provided with the braking arrangement as claimed in claim 1.

7. The dispenser as claimed in claims wherein said roll of paper is intended to be arranged in said dispenser such that said longitudinal axis of said roll of paper is aligned with said downstream direction.

8. The dispenser as claimed in claim 6, wherein said roll of paper is intended to be arranged in said dispenser such that said longitudinal axis of said roll of paper is substantially parallel to said first and second axis.

9. The dispenser as claimed in claim 6, wherein the dispenser is intended to house perforated paper.

10. The braking arrangement as claimed in claim 5, wherein each gearwheel includes 12 teeth.

* * * * *